United States Patent [19]

Taylor

[11] 3,952,954

[45] Apr. 27, 1976

[54] AUTOMATIC WATER SPRINKLER FOR IRREGULAR AREAS

[76] Inventor: Robert E. Taylor, 309 SW. 11th St., Andrews, Tex. 79714

[22] Filed: Feb. 28, 1975

[21] Appl. No.: 553,906

[52] U.S. Cl. ..... 239/236; 239/DIG. 1

[51] Int. Cl.[2] ..... B05B 3/08

[58] Field of Search ..... 239/61, 62, 69, 97, 239/98, 236, 252, DIG. 1

[56] References Cited

UNITED STATES PATENTS

| | | | |
|---|---|---|---|
| 2,601,559 | 6/1952 | Riblet | 239/DIG. 1 |
| 2,780,488 | 2/1957 | Kennedy | 239/DIG. 1 |
| 2,805,098 | 9/1957 | Hurley | 239/DIG. 1 |
| 2,999,643 | 9/1961 | Kennedy | 239/252 |
| 3,095,148 | 6/1963 | Smith | 239/236 |
| 3,452,930 | 7/1969 | Karbo | 239/236 |
| 3,464,628 | 9/1969 | Chow | 239/236 |
| 3,654,817 | 4/1972 | Kane | 239/DIG. 1 |
| 3,786,991 | 1/1974 | Ingham | 239/236 |

*Primary Examiner*—Lloyd L. King
*Attorney, Agent, or Firm*—Marcus L. Bates

[57] ABSTRACT

An automatic sprinkler having apparatus by which it can be programmed to uniformly distribute water over a number of different irregular patterns.

A programmer has a sensor device connected thereto for manipulating both a speed control means and a nozzle in a manner whereby the speed of rotation of the nozzle means about a support base, as well as the angle of elevation of the water leaving the nozzle, is controlled in a manner to uniformly distribute water over an irregular pattern.

6 Claims, 9 Drawing Figures

AUTOMATIC WATER SPRINKLER FOR IRREGULAR AREAS

BACKGROUND OF THE INVENTION

In the prior art made of record herein, there is disclosed various sprinkler devices for watering irregular areas. Some known sprinkler apparatus are complex in design and expensive in cost and accordingly must be confined to an affluent marketplace. Other sprinklers fail to uniformly distribute the water while following an irregular pattern and some degree of consumer dissatisfaction is to be expected in such an instance. None of the prior art teaches an automatic sprinkler system which can be programmed in a simple manner so that the rotating nozzle associated therewith can be made to uniformly distribute the water over a number of irregular areas.

Accordingly, it is desirable to have an automatic water sprinkler apparatus which uniformly waters an irregular area, and which can be programmed to follow any number of different irregular patterns in a simple and uncomplicated manner.

| PRIOR ART | |
|---|---|
| Pottenger, Jr. | 1,796,942 |
| Ashworth | 2,475,537 |
| Riblet | 2,601,559 |
| Salminen | 2,757,956 |
| Kennedy | 2,780,488 |
| Woods | 2,962,220 |
| Boyden | 2,976,271 |
| Carlson | 3,575,347 |
| Lindgren | 3,648,928 |
| Kane | 3,654,817 |
| Felix | 3,712,545 |

SUMMARY OF THE INVENTION

An automatic sprinkler apparatus for watering irregular areas comprising a programmer, speed control means, a nozzle arranged to rotate about a base while the angle of elevation of the nozzle, or the trajectory of the water spray, can be adjusted to control the radial distance the water travels therefrom. The sensor is arranged to adjust the speed control means and the angle of the water leaving the nozzle so that time and distance of any finite area subjected to water flowing from the apparatus is maintained constant by the device.

In one embodiment of the invention, the speed control is in the form of a hydraulic brake means having a closed loop bypass system. Another embodiment of the invention discloses a water driven motor having a flow control valve. Either above expedient provides the system with a speed control means.

A primary object of the present invention is the provision of improvements in automatic sprinklers for watering irregular areas.

Another object of the invention is to provide a watering device for uniformly distributing water over an irregular area.

A further object of this invention is to disclose and provide an apparatus which can be connected to a supply of water and programmed whereby an irregular area is uniformly watered.

A still further object of this invention is to provide a watering device having an adjustable programming means which controls the rate of rotation of a nozzle about a base, and the angle of divergence of water leaving the nozzle, and the trajectory of the water flowing from the nozzle.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Figure 1:
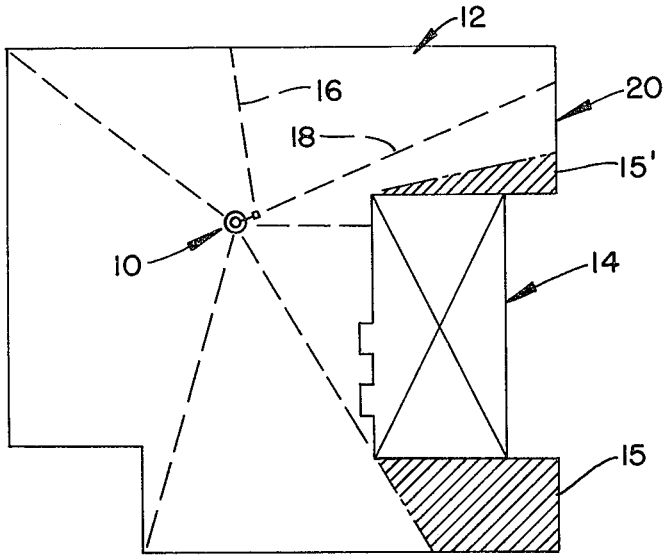
FIG. 1 is a schematical top plan view of the present invention and its operative relationship to an irregular area and a building structure.

In FIG. 1 there is schematically illustrated an automatic sprinkler apparatus 10 for watering irregular areas 12 such as one may encounter about his home 14. The radial paths 16 and 18 of the water leaving the sprinkler are of different lengths, and therefore is controlled so that the irregular area 20 is uniformly watered, except for the illustrated shaded area 15, 15′, which are obscured from the path of the sprinkler by the home.

Figure 2:
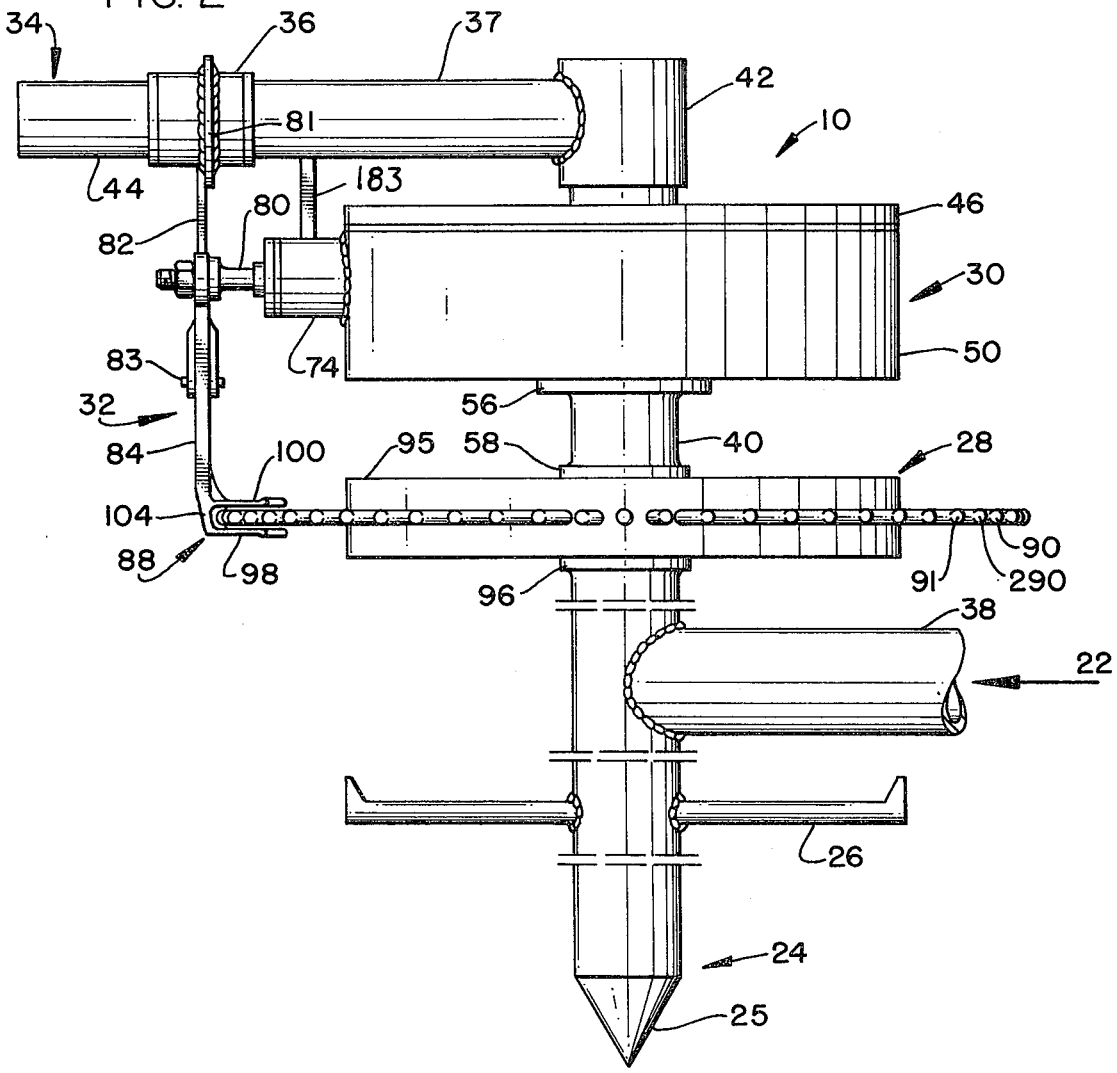
FIG. 2 is an enlarged, side elevational view of a water sprinkler apparatus made in accordance with the present invention, with some parts thereof being broken away therefrom.

In FIG. 2, a source of water is connected to inlet 22 with the water being under sufficient pressure for attaining a desired trajectory as it issues therefrom, which usually will be 30–60 psig. The apparatus includes a base 24 comprised of a ground engaging member 25 to which there is affixed radially disposed foot engaging members 26 rigidly mounted thereto. The base provides a support for a programmer device 28, which stores knowledge, as will be better appreciated later on in this disclosure.

Figure 6:
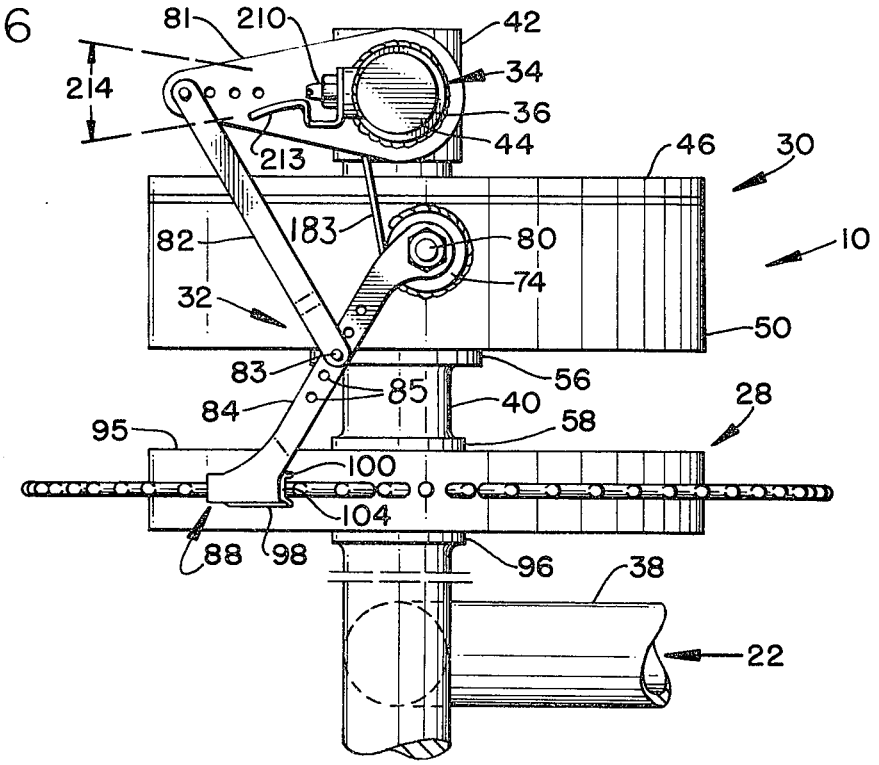
FIG. 6 is a side elevational view of the invention disclosed in FIG. 3.

Rotatable head assembly 30 supports a sensor means 32, while a sprinkler nozzle assembly 34 is affixed in overhanging relationship respective to the head, the base, and the sensor means. A nozzle, such as seen at 210 in FIG. 6, is affixed to assembly 34 and directs a jet of water from the invention, while an axial rotatable fluid coupling 36 enables the nozzle to be axially rotated respective to the central axis of a support arm 37.

Figure 3:
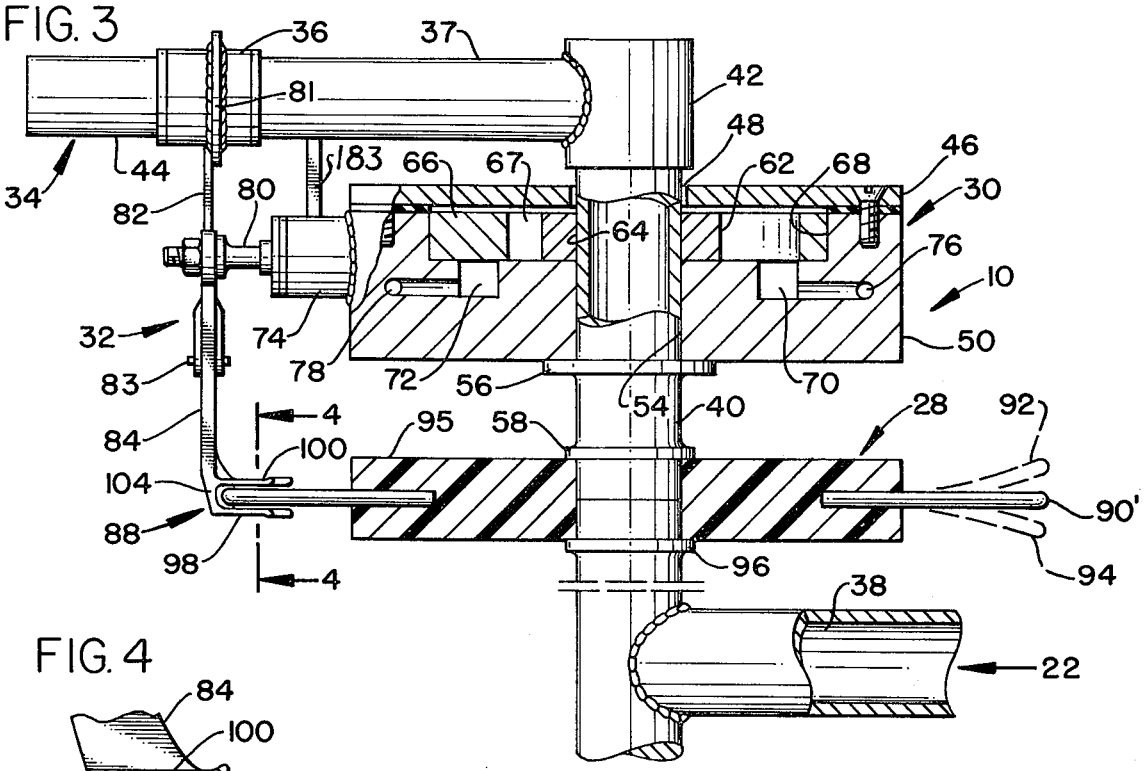
FIG. 3 is a longitudinal, part cross-sectional view of the apparatus disclosed in FIG. 2.
Figure 4:
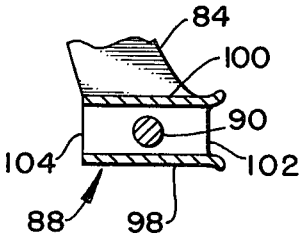
FIG. 4 is an enlarged, broken, cross-sectional view taken along line 4—4 of FIG. 3.

As best seen in FIG. 3, in conjunction with some of the remaining figures, horizontal passageway 38 flow connects inlet 22 to a vertical passageway 40 formed within the upper extremity of the support member. A second fluid coupling, in the form of a swivel elbow 42 flow connects the before mentioned horizontally disposed arm to the upper marginal end portion of the support member so that the axially rotatable conduit 44, which supports the nozzle, can be rotated axially with respect to the longitudinal central axis of arm 37, and arm 37 can be pivoted about conduit 40. Closure plate 46 is apertured at 48 and removably affixed to a rotatable upper housing member 50 which forms part of the rotatable head assembly 30.

Counterbore 54 slidably receives a marginal length of the upstanding hollow support member therein. Where deemed desirable, seal means may be interposed therebetween as may be required to preclude fluid flow thereacross. Spaced abutment means 56 and 58, respectively, affix the rotatable head assembly and the nonrotatable programmer suitably mounted to the support member.

The rotatable head assembly is provided with a speed control device in the form of a controllable brake means, the preferred form being a pump apparatus flow connected into a closed loop system and having a controlled bypass from the high to the low pressure side thereof. As specifically shown in the preferred embodiment of FIG. 3, the brake means comprises a rotary pump assembly having an inner pump lobe 62, hereinafter called a stator, which is affixed to a marginal intermediate portion 64 of the upstanding vertical support member. An outer pump lobe 66, hereinafter called the rotor, slidably engages a circumferentially extending wall surface 68 of the rotatable upper housing member in a manner whereby pivotal motion of the arm 37 about the support member imparts rotation into the rotatable head 30; thereby causing a pumping action to exist between the rotor and the stator, as will be more fully discussed later on in this disclosure.

Oil inlet 70 is diametrically spaced from oil outlet 72, with a variable speed control in the form of a valve means 74 being interposed therebetween by means of the inlet and outlet passageways, 76 and 78, respectfully. Shaft 80 manipulates the valve element and controls the rate of flow between passageways 76 and 78 of the closed loop flow system.

As best disclosed in FIG. 6, the fluid coupling 36 is seen to be rigidly affixed to an apertured arm 81, while a linkage 82 is connected thereto and to a control arm 84. Pin 83 is selectively placed within one of the apertures 85, while a sensor means in the form of a follower 88 is suitably mounted in fixed relationship to the free depending end of the speed control arm.

Figure 5:
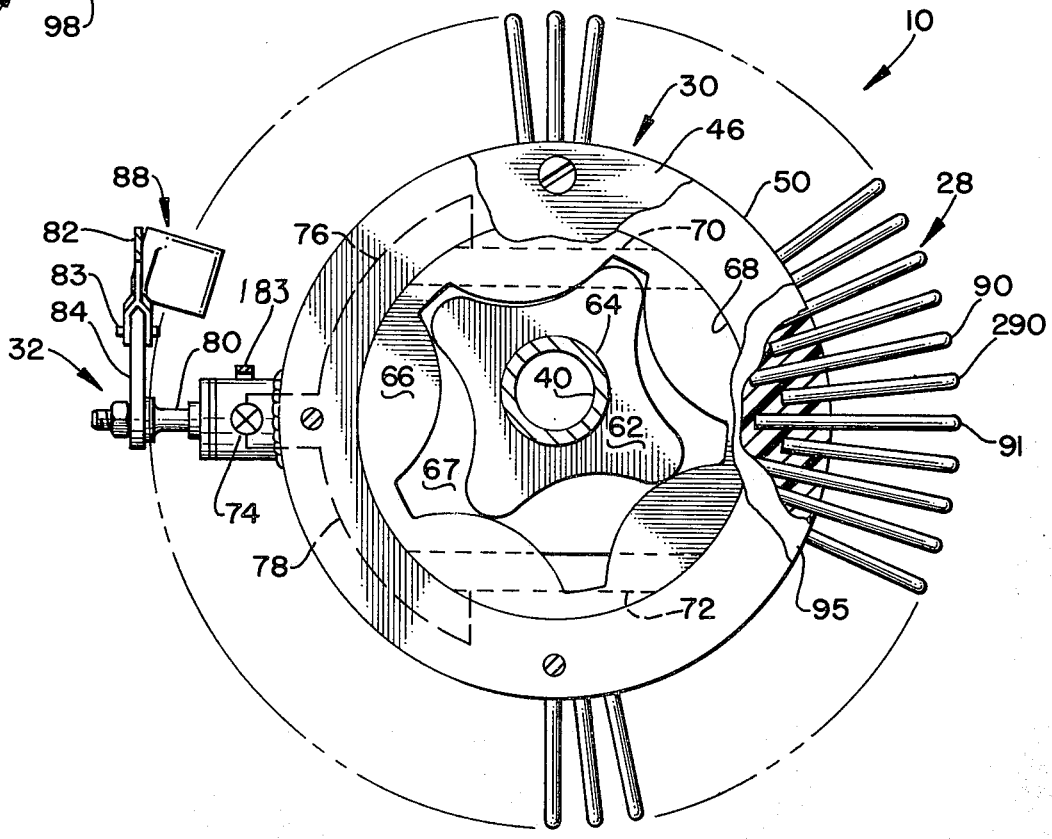
FIG. 5 is a top plan view of the apparatus disclosed in FIGS. 1, 3, and 4, with some parts thereof being removed therefrom, and other parts being cut away so as to reveal some of the details of construction.

As best seen in FIGS. 3 and 5, a plurality of bendable radial fingers, 90 and 91, have a fixed end portion embedded within an annular plastic member 95 of the programmer, while at least one free depending end portion of the fingers are received within the follower.

As specifically seen in FIG. 3, in conjunction with FIG. 5, the radial fingers can be bent into the dot-dash configuration broadly illustrated by numerals 92 and 94 so that a circumferentially extending sinuous pattern of any desired configuration can be attained by merely deforming some of the bendable fingers into any desired position. Shoulder 96 of the cylindrical support member abuttingly engages the plastic member so that it is held in fixed relationship thereto.

The follower includes a lower guide means 98 spaced from an upper similar guide means 100 by the illustrated web member so that the follower has a leading edge portion 102 and a trailing edge portion 104 which captures one or more fingers therewithin as the rotatable head moves the follower about the outer circumferentially extending marginal edge portion of the fingers.

As best seen in FIG. 5, together with some of the remaining figures, the radial fingers may be made of a bendable material, such as aluminum, in the illustrated manner indicated by numerals 90 and 91. Alternatively, the fingers may be provided with an outwardly diverging flat plastic coating, thereby providing a more continuous or less interrupted circumferentially extending marginal edge portion. Alternate metal rods 290 may be shortened relative to the adjacent rods, such that a greater number of the fingers may be molded into the plastic annular disc.

Figure 7:
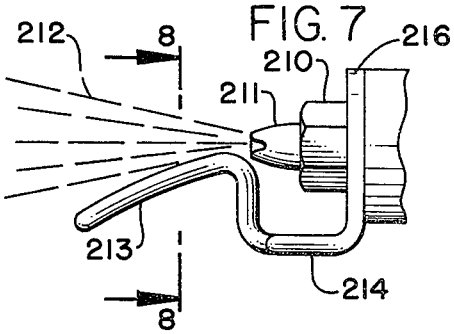
FIG. 7 is an enlarged detail of the nozzle apparatus of the invention.
Figure 8:
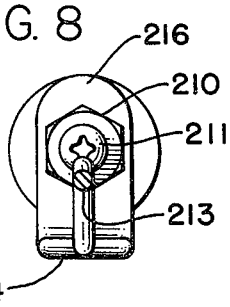
FIG. 8 is a view taken along line 8—8 of FIG. 7.

In FIG. 7, the nozzle 210 supports a metal deflector 213 which has the illustrated curved surface thereof placed tangentially to the axial passageway of the outlet, such that a "rooster tail" 212 is generated when water flows therethrough. This action distributes water more uniformly along the trajectory defined by the main body of the spray.

Figure 9:
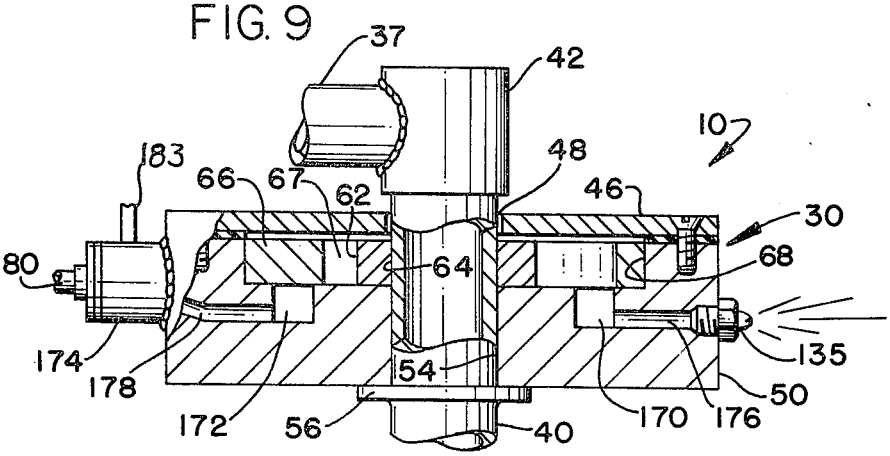
FIG. 9 shows another embodiment of the invention.

As an additional embodiment of the invention, the passageway 178 of FIG. 9 is seen to be connected to the interior of the arm by means of a valve 174, thereby providing chamber 172 with a high pressure secondary or parallel water supply, while the exhaust chamber 170 is connected to a nozzle assembly 135 by passageway 176. This arrangement causes the rotor and stator to become a water powered motor having a variable speed control effected by valve 74. The action of the valve is controlled in the same before described manner taught in FIGS. 2–6. The nozzle 135 sprays water closely adjacent to the sprinkler apparatus while the nozzle 35 sprays water onto the outer marginal periphery of the irregular area.

OPERATION

In operation, the automatic water sprinkler of the present invention is located in the most logical geometrical center of a yard to be watered, which will cause the apparatus to omit a minimum of obscured areas 15, 15'. Water under suitable pressure is connected by any conventional means to conduit 22; thereby enabling flow to occur along the flow path 22, 38, 40, 42, 37, 36, 44 and to the nozzle where a controlled spray of water 16 and 18 flows from the apparatus with sufficient force to impart rotational motion into the rotatable nozzle assembly. Pivotal movement of arm 37 about the support members causes the arm 83 to rotate the speed control assembly 30. This action imparts rotational motion into the rotor respective to the stator 62 which is affixed to the fixed support shaft. The oscillating and rotating action of the rotor respective to the stator causes fluid to flow from the illustrated valve assembly 74, along flow path 78, into the void or pump inlet 72, where the fluid is then forced into variable void 67. The action of the pump causes the fluid to be transferred into the port or outlet 70 where the fluid flows along the indicated flow path 76 to the control valve 174 in a closed loop circuit. It will be appreciated that the rotor and stator are similar to an automotive oil pump in design and operation.

As the rotating head moves respective to the radial fingers, the trailing arm 84 is positioned whereby the follower 88 of the sensor device captures the outer circumferentially extending marginal edge portion of the radial fingers therein, thereby axially rotating shaft 80 of the valve an amount depending upon the bend 92 and 94 imparted into the fingers of the programmer.

Circumferential movement of linkage 84 about shaft 80 imparts pivotal movement into the lever 81 which is connected to the coupling member; thereby causing nozzle 210 to rotate up to approximately 60°, between the limits indicated by the dot-dash lines at numeral 214, for example.

With the sprinkler operating, the fingers which are engaged by the follower are bent in either an upward or a downward direction to cause water leaving the nozzle to assume a proper trajectory so that the outermost periphery of the irregular area to be watered is reached by part of water 212 flowing from the nozzle. Therefore, bending the fingers 90 beyond their elastic limit and into an extreme position 92 will position the nozzle to reach the furthest periphery of the irregular area, while bending the fingers 90 downward into the illustrated position 94 will cause the nozzle to have a small trajectory; and accordingly, water therefrom will travel a short distance. Moreover, when the sensor is moved in a downward direction by a finger of the programmer, the valve means 74 is moved towards an open position; thereby reducing resistance to rotation of the head 30, and accordingly, the rotating head moves at an increased angular velocity because of the small area to be watered at this particular moment. Conversely, when the sensor is in an uppermost position, the water from the nozzle has a large trajectory and water therefrom must therefore cover a large area. Therefore, the valve is moved toward the closed position so as to resist rotation of the rotatable head; thereby increasing the length of time that the nozzle sprays water onto the large area.

Additional seal means can be employed in the apparatus wherever deemed necessary in order to avoid the necessity of replenishing the fluid within the speed control means. The arrangement of the linkage 81, 82, 84, and 88 can be rearranged if desired so that the sensor 88 is directly connected to link 82 while link 84 is connected to link 82, or to cause the arm 84 to lead rather than to trail the valve.

I claim:

1. An automatic sprinkler for watering irregular areas comprising:

a ground engaging support means, a programmer having means by which data can be stored therein related to a geometrical configuration of an irregular area, a nozzle assembly, means forming a flow path by which water flows to said nozzle, means forming a rotatable head having a speed control associated therewith by which the rate of rotation of said head is controlled;

means mounting said rotatable head to said support means, means mounting said nozzle in swiveled relationship respective to said rotatable head such that said nozzle rotates with said head and can be swiveled to change the trajectory of any water flowing therefrom; means by which any water flowing through said nozzle tends to impart rotational motion into said rotatable head;

said programmer includes a plurality of radially spaced circumferentially extending protrusions mounted to said ground engaging support means, each said protrusion being bendable respective to one another to jointly form a circumferentially extending sinusoidal pattern;

a follower slidably engaged with said protrusions so that the follower must assume the path presented by a marginal outer peripheral area of said protrusions when said follower is moved relative to said programmer; means connecting said follower to said nozzle and to said speed controller in a manner such that movement of the follower along the sinusoidal path of the programmer causes the speed controller to change the rate of rotation of the head while the follower simultaneously swivels the nozzle to change the trajectory of water issuing therefrom.

2. The automatic sprinkler of claim 1 wherein said speed control is a pump means, and further includes a closed loop flow circuit and a valve means, said valve means and said flow circuit being connected to control fluid flow through the pump means, said valve means being controlled by movement of said follower.

3. The automatic sprinkler of claim 1 wherein said flow path to said nozzle includes a flow passageway formed through said ground engaging member, said nozzle being flow connected to said passageway by a fluid coupling means;

said head underlying said nozzle; said speed control being a pump means contained within said head, a closed loop flow system having a valve means connected to control fluid flow through said pump means; said pump means being actuated when said head rotates respective to said ground engaging member;

the protrusions of said programmer lying in a plane which is parallel to a plane described by said rotating nozzle; linkage means connecting said follower to said valve and to said nozzle to cause the nozzle to swivel in a direction to increase the trajectory of a stream of water flowing therefrom while simultaneously the valve means causes the pump means to decrease the rate of rotation of the nozzle.

4. Sprinkler apparatus having an arm, a ground engaging support member, means by which said arm is pivotally secured to said ground engaging support member, a nozzle, including means by which it is swiveled to said arm, a speed control means, a sensor, and a programmer;

means rotatably mounting said speed control means to said support member for rotation concurrently with said arm, means mounting said programmer to said support member, means connecting said sensor to said nozzle, speed control means, and programmer such that the trajectory of water from said nozzle is increased while the rotational speed of said arm is decreased in response to changes in said programmer, so that the trajectory and rotational speed of the water issuing from the sprinkler can be regulated to thereby more uniformly distribute water over an irregular area;

said programmer includes a plurality of circumferentially extending fingers mounted to said ground engaging support means in radial spaced relationship thereto; said fingers being bendable to form a circumferentially extending sinusoidal pattern;

said sensor includes a follower, means slidably connecting said follower with said fingers so that the follower must assume the path presented by a marginal outer periphery of the fingers during rotation of said arm, and movement of the follower imparts movement into the speed control means and said nozzle.

5. The automatic sprinkler of claim 4 wherein said speed control means includes a pump means connected to be actuated by relative movement between the ground engaging member and the arm; a closed loop flow circuit including a valve means, said valve means and said flow circuit being connected to control fluid flow through the pump means, said valve being controlled by said follower.

6. The sprinkler of claim 4 wherein said flow path to said nozzle includes a flow passageway formed through said ground engaging support member, said nozzle being flow connected to said passageway by a fluid coupling means;

a head underlying said nozzle; said speed control means including a pump means contained within said head, a closed loop flow system having a valve means connected to control fluid flow through said pump means; said pump means being actuated when said head rotates respective to said ground engaging member;

said fingers of said programmer lying in a plane which is parallel to a plane described by said rotating nozzle; linkage means connecting said follower to said valve and to said nozzle to cause the nozzle to swivel in a direction to increase the trajectory of a stream of water flowing therefrom while simultaneously the valve means causes the pump means to decrease the rate of rotation of the nozzle.

* * * * *